US005251888A

United States Patent [19]

Eugster

[11] Patent Number: 5,251,888

[45] Date of Patent: Oct. 12, 1993

[54] INSETTING MACHINE WITH POCKETS HAVING ADJUSTABLE STOPS

[75] Inventor: Albert Eugster, Strengelbach, Switzerland

[73] Assignee: Grapha-Holding AG, Hergiswil, Sweden

[21] Appl. No.: 753,976

[22] Filed: Sep. 3, 1991

[30] Foreign Application Priority Data

Sep. 12, 1990 [CH] Switzerland ..... 2965/90

[51] Int. Cl.[5] ..... B65H 39/02; B65H 5/30; B65H 31/20

[52] U.S. Cl. ..... 270/55; 270/54; 270/57; 270/58; 271/223; 198/803.11

[58] Field of Search ..... 270/52, 55, 57, 58, 270/45; 271/170, 223, 294, 295; 198/473.1, 803.11

[56] References Cited

U.S. PATENT DOCUMENTS

| | | | |
|---|---|---|---|
| 2,561,070 | 7/1951 | Phythian | 271/294 X |
| 3,031,189 | 4/1962 | Fornell et al. | 271/214 |
| 3,809,385 | 5/1974 | Rana | 270/54 |
| 3,851,871 | 12/1974 | Aronson | 271/99 X |
| 4,013,283 | 3/1977 | Tress et al. | 271/171 X |
| 4,373,710 | 2/1983 | Hansen et al. | 270/55 |
| 5,050,851 | 9/1991 | Eugster | 270/55 |

FOREIGN PATENT DOCUMENTS 0336062 10/1989 European Pat. Off. .

*Primary Examiner*—Edward K. Look
*Assistant Examiner*—John Ryznic
*Attorney, Agent, or Firm*—Martin A. Farber

[57] ABSTRACT

Each of the pockets (3), which are arranged at regular distances apart and are moveable along an endless path, is provided with two vertically adjustable stops (14, 15) for the printed product (12) placed into the pocket (3). The stops (14, 15) are mounted displaceably in a pocket carrier (8). Within the pocket carrier (8) there is horizontally arranged a slide (18) which has two elongated openings (19, 20) of slight inclination to the horizontal. A projection (21, 22) on each stop (14, 15) is guided in the corresponding opening (19, 20) of the slide (18). A displacement of the slide (18) accordingly effects a vertical displacement of the stops (14, 15). A guide member (28) which is displaceable in the direction of the slide (18) on a carrier (29) fixed to the machine has a guide groove (32) for a projection (27) arranged on the protruding end of the slide (18). Upon the moving past of the pockets (3), the projection (27) moves through the guide groove (32) so that the slide (18) is brought into a corresponding horizontal position and the stops (14, 15) are brought into a corresponding vertical position. Upon change of the height of the printed product (12), therefore, only the guide member (28) need be newly set on the carrier (29) in order for the printed products (12) to lie at the correct height in all pockets (3).

8 Claims, 3 Drawing Sheets

INSETTING MACHINE WITH POCKETS HAVING ADJUSTABLE STOPS

The present invention relates to an insetting machine having pockets to receive printed products, the pockets being arranged at regular intervals moveable along an endless path.

Such an insetting machine is known from European Patent Application No. 0 336 062. The known insetting machine is provided with means, namely, a spreading member, in order to open the print products present in the pockets in front of a supplement insetting station. In order to avoid the time-consuming adjustment of all pockets or their pocket walls with respect to the spreading member when there is a change in thickness of the printed products which are to be provided with a supplement, in the known insetting machine such means are arranged traveling in synchronism with the pockets in front of the first supplement insetting station along a portion of the endless path. This has the advantage that upon change to a new, thicker printed product the means need be adjusted only with respect to a single pocket.

If now, however, no change is present or not only a change in the thickness of the printed product but also a change in its format, in particular of its height in the approximately vertical pocket direction, then each pocket must as previously be adjusted individually in order to provide assurance that the upper edge of the printed product remains at unchanged height. Particularly in the case of a large number of pockets this requires a considerable time for adjustment and, therefore, down time.

The object of the present invention is to provide an insetting machine of the aforementioned type in which all pockets are adapted to a modified height of the printed products automatically on basis of a single displacement manipulation.

The insetting machine of the aforementioned type in accordance with the present invention wherein each pocket is provided with a pocket carrier and at least one vertically displaceable stop for one of the printed products, the stop being connected in a self-retaining manner with the pocket, the insetting machine comprises fixed displaceable control means for providing vertical adjustment of the stop of the pocket as the pocket is moved along the endless path.

The insetting machine of the invention has the advantage that only one revolution of all pockets past the preset control means is necessary in order to bring the stops of the pockets for the printed products automatically into the correct height.

A preferred development of the insetting machine of the invention is that the stop is arranged displaceable in the vertical direction in the pocket carrier. It has the advantage that the structural expense is less and a dependable setting of the stops of all pockets is assured.

The invention will be explained by way of example with reference to the accompanying diagrammatic drawings in which.

Figure 1:
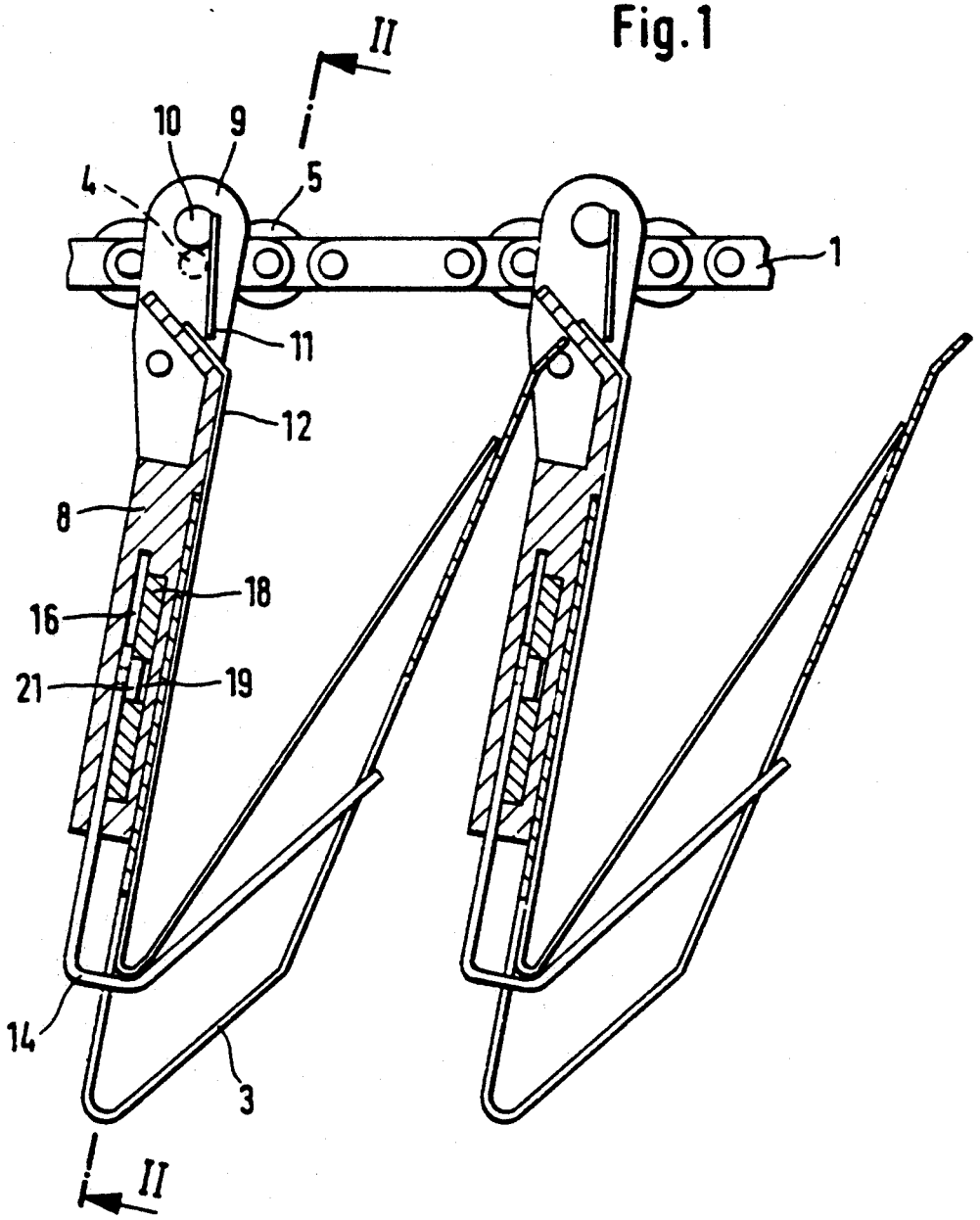
FIG. 1 is a side view, partially in section, of two pockets of the insetting machine.
Figure 2:
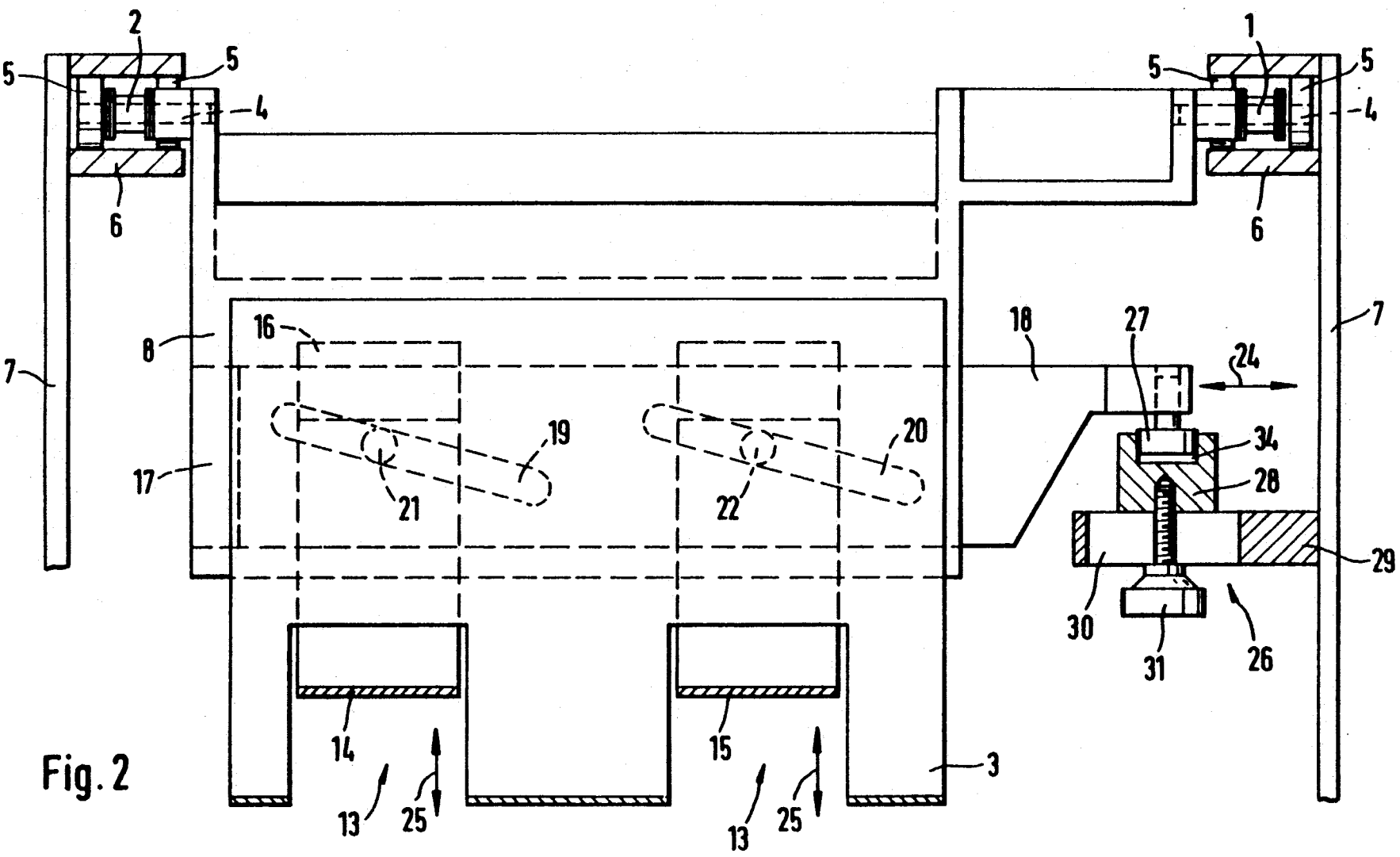
FIG. 2 is a section along the line II—II of FIG. 1 together with a displaceable control device.

On two parallelly revolving endless chains 1, 2 there are inserted a number of pockets 3 corresponding to the chain pitch, two of which pockets 3 are shown in FIG. 1. The chains 1, 2 conduct the pockets along an endless path on which various treatment stations (not shown here) for printed products received in the pockets 3 can be arranged one behind the other, for instance a main-product insetting station, a supplement insetting station and a removal station. In known manner, the chains 1, 2 (FIG. 2) are provided with laterally protruding shafts 4. Guide rollers 5 are mounted for free rotation opposite each other on the chain links. Along the straight path of the chain the rollers 5 are mounted in lateral guides 6 which are arranged on fixed supports 7. In each case a pocket carrier 8 with the pocket 3 fastened to it is firmly connected to the shafts 4 (FIGS. 1, 2). From FIG. 1 it can, furthermore, be noted that in known manner a swing shaft 10 is rotatably mounted in support ribs 9 which are arranged on the pocket carrier 8. The swing shaft 10 bears a hold-down 11 for a printed product 12 inset into the pocket 3. As can be noted from FIG. 2, the pocket carrier 8 extends over the entire width of the pocket 3.

The pocket 3 is provided in its lower region with two cutouts 13 through each of which a respective stop 14, 15 which is bent similar to the pocket 3 engages, the stops 14, 15 are mounted for displacement in vertical direction in a corresponding slot 16 in the pocket carrier 8. Adjoining the slot 16 the pocket carrier 8 is provided with a groove 17 which extends in the horizontal width direction, a slide 18 being arranged in said groove. The slide 18 is thus moveable in horizontal direction in the pocket carrier 8.

The slide 18 and the two stops 14, 15 are mechanically connected to each other. The slide 18 is provided with two elongated openings 19, 20 which are inclined with respect to the longitudinal axis of the slide 18. Each stop 14, 15 bears a projection 21, 22 which lies in a corresponding elongated opening 19, 20 and is thus guided therein. When the slide 18 is moved in the direction of its longitudinal axis, therefore in horizontal direction in FIG. 2 corresponding to the double-ended arrow 24, the two stops 14, 15 accordingly are shifted simultaneously and to the same extent in substantially vertical direction, as indicated by the double-ended arrows 25. Since the stops 14, 15 form a support for the lower edge (i.e. the fold) of the printed product 12 placed into the pocket 3 (FIG. 1), movement of the slide 18 effects a displacement of the vertical position of the printed product 12 in the pocket 3. The stops 14, 15 are automatically held in this connection in the pocket 3 since the slight inclination of the guide openings 19, 20 of the slide 18 with respect to the horizontal prevents automatic vertical movement of the stops 14, 15.

Figure 3:
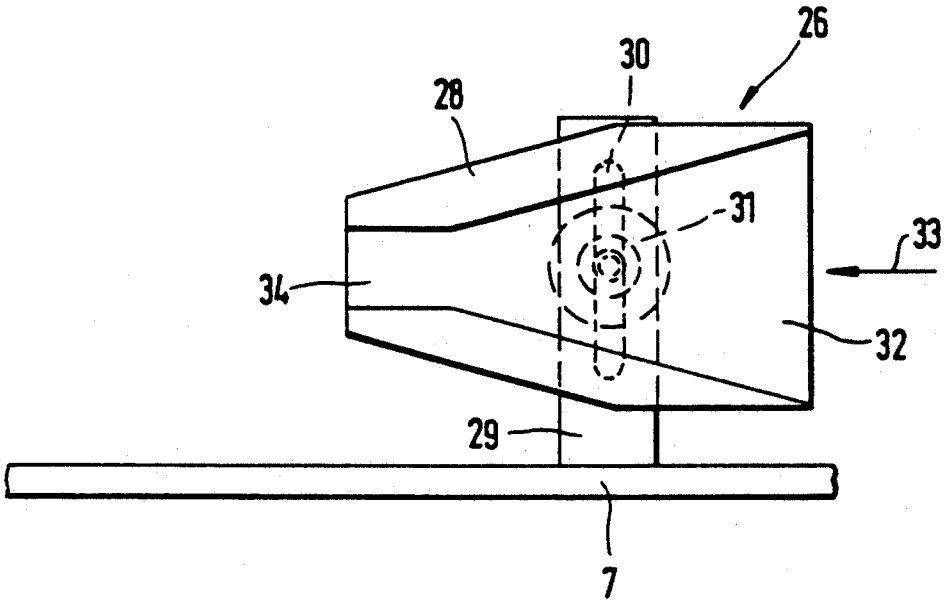
FIG. 3 is a top view of the control device of FIG. 2.

In order to effect an automatic desired vertical adjustment of the stops 14, 15 of all pockets, a displacement device, designated generally as 26 in FIGS. 2 and 3, is provided for the slide 18 of the pockets 3. The slide 18 is provided on one side on its laterally protruding end with a projection 27 (FIG. 2). On the other side, a guide member 28 is arranged on the adjacent fixed support 7, the guide member being mounted on the carrier 29 which is connected with the support 7. The carrier 29 is proved with a narrow longitudinal opening 30 through which a lock screw 31 screwed into the guide body 28 extends. As shown in FIG. 3, the guide body 28 has a guide groove 32 for the projection 27 of the slide 18.

The guide groove 32 has a narrowing course in the direction of movement of the pockets 3 indicated by an arrow 33, the narrowest place 34 of the guide groove 32 having a width corresponding to the diameter of the projection 27. Thus, in operation, the slides 18 of all pockets 3 which are moved past the displacement device 26 are brought into the same horizontal position, which is determined by the position of the guide body 28 locked in the opening 30 of the carrier 29. The horizontal position of the slide 28 determines the vertical position of the stops 14, 15 and thus the vertical position of the printed products 12 in the pockets 3.

If the vertical position of the printed products 12 in the pockets 3 is accordingly to be adapted to a different width of the printed products 12, then only the guide member 28 need be displaced on the carrier 29 in the direction towards the opening 30, for which purpose the carrier 29 can be provided with a corresponding scale. Upon the first passage of the pockets 3 past the displacement device 26 the slides 18 of all pockets 3 are then automatically brought into the proper position. This position, which is determined by the locked guide body 28, is, furthermore, automatically checked upon each further passage of the pockets and corrected in case of minor deviations.

I claim:

1. An insetting machine having pockets to receive printed products, the pockets being arranged at regular intervals moveable along an endless path, wherein each pocket is provided with a pocket carrier and at least one vertically displaceable stop for one of the printed products, the stop being connected in a self-retaining manner with the pocket;

the insetting machine comprises fixed displaceable control means for providing vertical adjustment of the stop of the pocket as the pocket is moved along the endless path; and the stop is arranged displaceable in vertical direction in the pocket carrier.

2. An insetting machine according to claim 1, wherein two stops are arranged spaced apart alongside of each other in the pocket carrier, and the stops extend through corresponding cutouts in the pocket.

3. An insetting machine according to claim 1, further comprising a laterally displaceable sliding control block for providing a vertical displacement of the stop.

4. An insetting machine according to claim 3, wherein the sliding control block is a slide which is provided with at least one elongated opening inclined to the lateral direction of movement of the slide; and each stop is provided in the region thereof guided in the pocket carrier with a projection which is guided in the longitudinal opening of the slide.

5. An insetting machine according to claim 3, further comprising a stationary machine part, and a displacement device for the lateral displacement of the sliding control block on the stationary machine part.

6. An insetting machine according to claim 5, wherein the displacement device has a guide member which is displaceable on the stationary machine part in the direction of movement of the sliding control block, said guide member being provided with a narrowing guide groove; and an end region of the sliding control block has a projection which, upon the movement of the pockets along the endless path, is guided in the groove in the direction from its widest place to its narrowest place.

7. An insetting machine having pockets for receiving printed products, the pockets being arranged at regular intervals movable along an endless path, wherein each pocket has at least one stop which is adjustable in height for the printed product;

said stop is connected in self-locking manner to the pocket; and the insetting machine comprises fixed, adjustable control means for adjusting a height of the stop of the pocket as the pocket moves along the endless path.

8. An insetting machine having pockets least receive printed products, the pockets being arranged at regular intervals moveable along an endless path, wherein each pocket has at lelast one vertically displaceable stop, and said stops being vertically adjustable as the pockets are moved along the endless path.

* * * * *

UNITED STATES PATENT AND TRADEMARK OFFICE

CERTIFICATE OF CORRECTION

PATENT NO. : 5,251,888

DATED : October 12, 1993

INVENTOR(S) : Albert Eugster

It is certified that error appears in the above-identified patent and that said Letters Patent is hereby corrected as shown below:

On the title page, item [73], change "Sweden" to --Switzerland--

Signed and Sealed this

Thirty-first Day of May, 1994

Bruce Lehman

*Attest:*

BRUCE LEHMAN

*Attesting Officer*

*Commissioner of Patents and Trademarks*